US009238376B2

(12) United States Patent
Ochi et al.

(10) Patent No.: US 9,238,376 B2
(45) Date of Patent: Jan. 19, 2016

(54) THERMAL HEAD AND THERMAL PRINTER EQUIPPED WITH THE SAME

(71) Applicant: KYOCERA Corporation, Kyoto-shi, Kyoto (JP)

(72) Inventors: Kouji Ochi, Kyoto (JP); Hiroshi Masutani, Kyoto (JP); Youichi Moto, Kyoto (JP); Yoshihiko Fujiwara, Kyoto (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 14/361,203

(22) PCT Filed: Nov. 26, 2012

(86) PCT No.: PCT/JP2012/080458

§ 371 (c)(1),
(2) Date: May 28, 2014

(87) PCT Pub. No.: WO2013/080915

PCT Pub. Date: Jun. 6, 2013

(65) Prior Publication Data

US 2014/0333708 A1 Nov. 13, 2014

(30) Foreign Application Priority Data

Nov. 28, 2011 (JP) ..... 2011-259092
Apr. 26, 2012 (JP) ..... 2012-101317

(51) Int. Cl.
*B41J 2/335* (2006.01)
*B41J 11/04* (2006.01)

(52) U.S. Cl.
CPC ..... *B41J 2/3353* (2013.01); *B41J 2/3355* (2013.01); *B41J 2/3357* (2013.01); *B41J 2/33525* (2013.01); *B41J 11/04* (2013.01)

(58) Field of Classification Search
USPC ..... 347/200, 203
See application file for complete search history.

(56) References Cited

U.S. PATENT DOCUMENTS 4,595,823 A 6/1986 Sorimachi et al.
6,441,839 B1 * 8/2002 Masutani et al. ..... 347/203

(Continued)

FOREIGN PATENT DOCUMENTS

JP 58-072477 A 4/1983
JP 59-169871 A 9/1984

(Continued)

OTHER PUBLICATIONS

Machine-generated translation of JP 2010-247470 , published on Nov. 2010.*

(Continued)

*Primary Examiner* — Huan Tran
(74) *Attorney, Agent, or Firm* — Volpe and Koenig, P.C.

(57) ABSTRACT

There are provided a thermal head capable of decreasing the possibility of occurrence of layer separation in a protective layer, and a thermal printer equipped with the same. A thermal head includes a substrate; an electrode disposed on the substrate; an electric resistor connected to the electrode, part of which serves as a heat-generating section; and a protective layer disposed on the electrode and on the heat-generating section. The protective layer includes a first layer containing silicon nitride or silicon oxide; and a second layer disposed on the first layer, containing tantalum oxide and silicon oxynitride.

13 Claims, 3 Drawing Sheets

(56) References Cited

U.S. PATENT DOCUMENTS

| | | | |
|---|---|---|---|
| 2010/0071198 | A1 | 3/2010 | Iino et al. |
| 2011/0187807 | A1 | 8/2011 | Masutani et al. |

FOREIGN PATENT DOCUMENTS

| | | | | | |
|---|---|---|---|---|---|
| JP | 60-107364 | * | 6/1985 | ..... | 347/200 |
| JP | 61-158475 | * | 7/1986 | ..... | 347/203 |
| JP | 62-095245 | A | 5/1987 | | |
| JP | 63-141764 | A | 6/1988 | | |
| JP | 4-49057 | A | 2/1992 | | |
| JP | 5-50628 | A | 3/1993 | | |
| JP | 2004-154969 | A | 6/2004 | | |
| JP | 2010-076157 | A | 4/2010 | | |
| JP | 2010-149515 | A | 7/2010 | | |
| JP | 2010-247470 | A | 11/2010 | | |
| WO | 2009/157269 | A1 | 12/2009 | | |

OTHER PUBLICATIONS

Machine-generated translation of JP 2004-154969, published on Jun. 2004.*

Machine-generated translation of JP 2010-149515, published on Jul. 2010.*

International Search Report, PCT/JP2012/080458, Dec. 5, 2012, 2 pps.

Japanese Office Action with English concise explanation, Japanese Patent Application No. 2013-547138, Feb. 17, 2015, 5 pgs.

Decision of Refusal with English concise explanation, Japanese Patent Application No. 2013-547138, Jul. 14, 2015, 5 pgs.

* cited by examiner

THERMAL HEAD AND THERMAL PRINTER EQUIPPED WITH THE SAME

TECHNICAL FIELD

The present invention relates to a thermal head and a thermal printer equipped with the same.

BACKGROUND ART

Various types of thermal heads have been proposed to date as printing devices for use in facsimiles, video printers, or the like. For example, there is known a thermal head comprising: a substrate; an electrode disposed on the substrate; an electric resistor connected to the electrode, part of which serves as a heat-generating section; and a protective layer disposed on the electrode, as well as on the heat-generating section (refer to Patent Literature 1, for example). In Patent Literature 1, there is described a protective layer obtained by disposing a first layer made of $SiO_2$ on the electrode and the heat-generating section, and then disposing a second layer made of $Ta_2O_5$ on the first layer.

CITATION LIST

Patent Literature

Patent Literature 1: Japanese Unexamined Patent Publication JP-A 58-72477 (1983)

SUMMARY OF INVENTION

Technical Problem

In the thermal head described in Patent Literature 1, the $Ta_2O_5$-made second layer is disposed on the $SiO_2$-made first layer. Therefore, there is a possibility that the second layer will be separated from the first layer due to the difference in thermal expansion coefficient between the first layer and the second layer.

Solution to Problem

A thermal head in accordance with one embodiment of the invention comprises: a substrate; an electrode disposed on the substrate; an electric resistor connected to the electrode, part of which serves as a heat-generating section; and a protective layer disposed on the electrode and on the heat-generating section. Moreover, the protective layer includes a first layer containing silicon nitride or silicon oxide, and a second layer disposed on the first layer, containing tantalum oxide and silicon oxynitride.

A thermal printer in accordance with one embodiment of the invention comprises: the thermal head as above described; a conveyance mechanism which conveys a recording medium onto the heat-generating section; and a platen roller which presses the recording medium onto the heat-generating section.

Advantageous Effects of Invention

According to the invention, it is possible to decrease the possibility of occurrence of layer separation in the protective layer.

DESCRIPTION OF EMBODIMENTS

Figure 1:
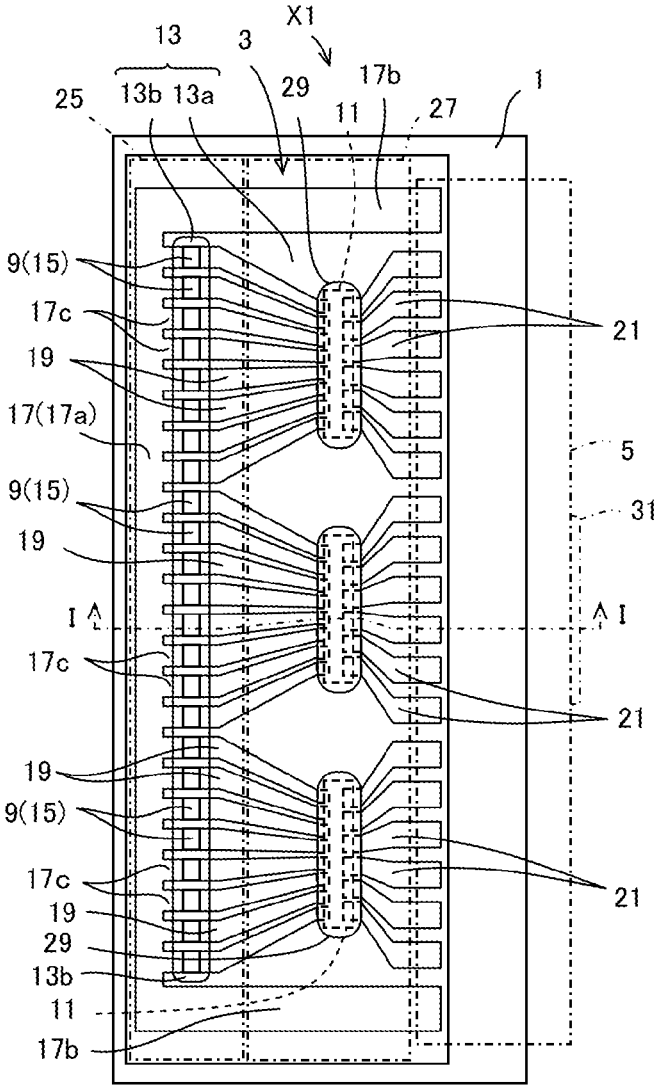
FIG. 1 is a plan view showing one embodiment of a thermal head pursuant to the invention.
Figure 2:
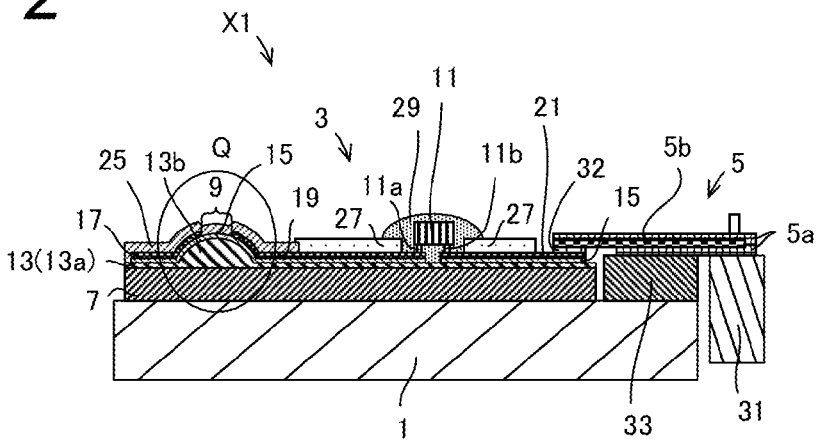
FIG. 2 is a sectional view of the thermal head taken along the line I-I shown in FIG. 1.

Hereinafter, one embodiment of a thermal head pursuant to the invention will be described with reference to the drawings. As shown in FIG. 1 and FIG. 2, the thermal head X1 of the present embodiment comprises: a heat dissipator 1; a head base body 3 placed on the heat dissipator 1; and a flexible printed circuit board 5 (hereafter referred to as "FPC 5") connected to the head base body 3. In FIG. 1, the diagrammatic representation of the FPC 5 is omitted, and a region where the FPC 5 is placed is indicated by alternate long and short dashed lines.

The heat dissipator 1 is formed as a plate having a rectangular shape as seen in a plan view. The heat dissipator 1 is made of a metal material such for example as copper, iron, or aluminum, and, as will hereafter be described, has the function of dissipating, out of heat generated by a heat-generating section 9 of the head base body 3, part of the heat which does not contribute to printing. Moreover, on the upper surface of the heat dissipator 1 is bonded the head base body 3 by means of double-faced tape, an adhesive, or otherwise (not shown in the drawings).

The head base body 3 comprises: a substrate 7 having a rectangular shape as seen in a plan view; a plurality of heat-generating sections 9 placed in an array on the substrate 7 along a longitudinal direction of the substrate 7; and a plurality of driving ICs 11 arranged on the substrate 7 along an arrangement direction of the heat-generating sections 9.

The substrate 7 is made of an electrically insulating material such as alumina ceramic, a semiconductor material such as single-crystal silicon, or the like.

A heat-accumulating layer 13 is disposed on the upper surface of the substrate 7. The heat-accumulating layer 13 comprises a base part 13*a* and a protuberant part 13*b*. The base part 13*a* is disposed on the entire area of the upper surface of the substrate 7. The protuberant part 13*b* extends in the form of a strip along the arrangement direction of the plural heat-generating sections 9, has a substantially semi-elliptical sectional profile, and acts to successfully press a recording medium to be printed against a protective layer 25 which will hereafter be described.

Moreover, the heat-accumulating layer 13, which is made for example of glass having a low heat conductivity, accumulates part of heat generated by the heat-generating section 9 temporarily in order to shorten the time required for a temperature rise in the heat-generating section 9 for an improvement in the thermal response characteristics of the thermal head X1. For example, the heat-accumulating layer 13 is formed by applying a specific glass paste, which is obtained by mixing a suitable organic solvent in glass powder, onto the upper surface of the substrate 7 by means of heretofore known screen printing or otherwise, and subsequently performing firing process.

As shown in FIG. 2, an electrical resistance layer 15 is disposed on the upper surface of the heat-accumulating layer 13. The electrical resistance layer 15 is interposed between the heat-accumulating layer 13 and a common electrode 17, a discrete electrode 19, a connection electrode 21 that will hereafter be described. As shown in FIG. 1, when viewed in a plan view, the electrical resistance layer 15 has a region corresponding in shape to the common electrode 17, the discrete electrode 19, and the connection electrode 21 (hereafter referred to as "interposition region") and a plurality of regions that are left exposed between the common electrode 17 and the discrete electrode 19 (hereafter referred to as "exposed regions"). In FIG. 1, the interposition region of the electrical resistance layer 15 is hidden behind the common electrode 17, the discrete electrode 19, and the connection electrode 21.

Each of the exposed regions of the electrical resistance layer 15 constitutes the above-described heat-generating section 9. As shown in FIG. 1, a plurality of exposed regions are placed in an array on the protuberant part 13*b* of the heat-accumulating layer 13, for constituting the heat-generating sections 9. The plural heat-generating sections 9, while being shown schematically in FIG. 1 for convenience in explanation, are arranged at a density of 600 dpi to 2400 dpi (dot per inch).

The electrical resistance layer 15 is made of a material having a relatively high electrical resistance such for example as a tantalum nitride (TaN)-based material, a tantalum silicon oxide (TaSiO)-based material, a tantalum silicon oxynitride (TaSiNO)-based material, a tantalum silicon oxide (TiSiO)-based material, a titanium silicon carbonate (TiSiCO)-based material, or a niobium silicon oxide (NbSiO)-based material. Accordingly, when a voltage is applied between the common electrode 17 and the discrete electrode 19 as will hereafter be described for the supply of electric current to the heat-generating section 9, then the heat-generating section 9 generates heat due to Joule heat generation.

As shown in FIG. 1 and FIG. 2, the common electrode 17, a plurality of discrete electrodes 19, and a plurality of connection electrodes 21 are disposed on the upper surface of the electrical resistance layer 15. The common electrode 17, the discrete electrode 19, and the connection electrode 21 are made of a material having electrical conductivity, and more specifically, for example, one of the following metals: aluminum; gold; silver; and copper, or an alloy of these metals.

The common electrode 17 is intended to provide connection between the plural heat-generating sections 9 and the FPC 5. As shown in FIG. 1, the common electrode 17 comprises a main wiring part 17*a*, a sub wiring part 17*b*, and a lead part 17*c*. The main wiring part 17*a* extends along one of the longer sides of the substrate 7. The sub wiring part 17*b* extends along each of one and the other shorter sides of the substrate 7, and has its one end connected to the main wiring part 17*a* and its other end connected to the FPC 5. Each lead part 17*c* individually extends from the main wiring part 17*a* toward each heat-generating section 9, and has its front end connected to the corresponding heat-generating section 9. Upon connection of the other end of the sub wiring part 17*b* to the FPC 5, the common electrode 17 provides electrical connection between the FPC 5 and each of the heat-generating sections 9.

The plural discrete electrodes 19 are intended to provide connection between each of the heat-generating sections 9 and the driving IC 11. As shown in FIG. 1 and FIG. 2, each discrete electrode 19 individually extends in strip form from each heat-generating section 9 toward a region where the driving IC 11 is placed in a manner such that the discrete electrode 19 has its one end connected to the corresponding heat-generating section 9 and has its other end located in the driving IC 11 placement region. Upon connection of the other end of each of the discrete electrodes 19 to the driving IC 11, electrical connection is established between each of the heat-generating sections 9 and the driving IC 11. More specifically, under the condition where the plural heat-generating sections 9 are separated into a plurality of groups, the discrete electrode 19 provides electrical connection between the heat-generating sections 9 in each group and the driving IC 11 corresponding to the group.

In the present embodiment, as has already been described, the lead part 17*c* of the common electrode 17 and the discrete electrode 19 are connected to the heat-generating section 9, and, the lead part 17*c* and the discrete electrode 19 are located opposite to each other. Thus, in the present embodiment, the electrodes to be connected to the heat-generating section 9 are formed as a pair.

The plural connection electrodes 21 are intended to provide connection between the driving IC 11 and the FPC 5. As shown in FIG. 1 and FIG. 2, each of the connection electrodes 21 extends in strip form, with its one end located in the driving IC 11 placement region, and its other end located in the vicinity of the other one of the longer sides of the substrate 7. Upon connection of one and the other ends of the connection electrode 21 to the driving IC 11 and the FPC 5, respectively, the plural connection electrodes 21 provide electrical connection between the driving IC 11 and the FPC 5. Note that the plural connection electrodes 21 connected to each of the driving ICs 11 are constructed of a plurality of wiring lines having different functions.

As shown in FIG. 1 and FIG. 2, the driving IC 11 is placed in correspondence with each of the groups of the plural heat-generating sections 9, and is connected to the other end of the discrete electrode 19 and one end of the connection electrode 21. The driving IC 11, which is intended to control the current-carrying state of each of the heat-generating sections 9, is internally provided with a plurality of switching elements.

Each of the driving ICs 11 is internally provided with a plurality of switching elements (not shown in the drawings) so as to correspond to the respective discrete electrodes 19 connected to the respective driving ICs 11. As shown in FIG. 2, in each of the driving ICs 11, one connection terminal 11*a* connected to each of the switching elements is connected to the discrete electrode 19, and the other connection terminal 11*b* connected to each of the switching elements is connected to a ground electrode wiring line of the connection electrode 21 as above described.

The above-described electrical resistance layer 15, common electrode 17, discrete electrode 19, connection electrode 21 are each formed by stacking layers of constituent materials on the heat-accumulating layer 13 one after another by heretofore known thin-film forming technique such as sputtering, and subsequently defining a predetermined pattern in the resultant layered body by heretofore known technique such as photo-etching. Note that the common electrode 17, the discrete electrode 19, and the connection electrode 21 can be formed at one time through the same process steps.

As shown in FIG. 1 and FIG. 2, a protective layer 25 which covers the heat-generating section 9, part of the common electrode 17, and part of the discrete electrode 19 is disposed on the heat-accumulating layer 13 disposed on the upper surface of the substrate 7. In FIG. 1, for convenience in explanation, a region where the protective layer 25 is disposed is indicated by alternate long and short dashed lines, and its diagrammatic representation is omitted. In the illustrated example, the protective layer 25 is so disposed as to cover the left-hand area of the upper surface of the heat-accumulating layer 13. Thus, the protective layer 25 is disposed on the heat-generating section 9, the main wiring part 17*a* of the common electrode 17, part of the sub wiring part 17*b*, the lead part 17*c*, and the discrete electrode 19.

The protective layer 25 is intended to protect the covered areas of the heat-generating section 9, the common electrode 17, and the discrete electrode 19 from corrosion caused for example by the adherence of atmospheric water content, or from wear caused by the contact with a recording medium to be printed.

Figure 3:
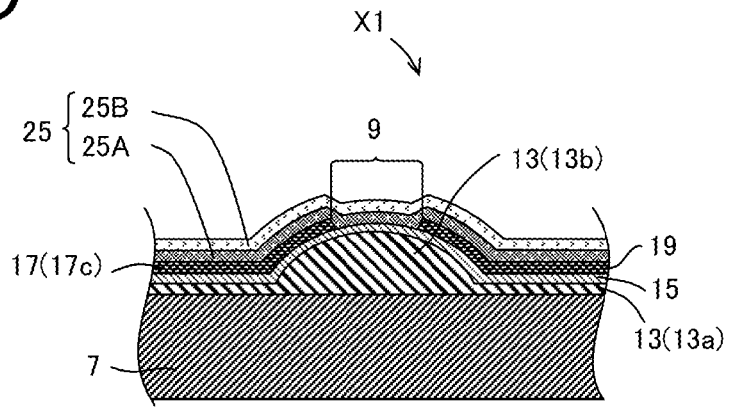
FIG. 3 is an enlarged view of a region Q shown in FIG. 2.

More specifically, as shown in FIG. 3, the protective layer 25 comprises a first layer 25A provided on the heat-generating section 9, the common electrode 17, and the discrete electrode 19, and a second layer 25B provided on the first layer 25A.

The first layer 25A is an electrically insulating layer containing silicon nitride (hereafter also referred to as "SiN"). The first layer 25A, while making contact with both of the common electrode 17 and the discrete electrode 19 as shown in FIG. 3, is capable of preventing short-circuiting of the common electrode 17 and the discrete electrode 19 by virtue of its electrical insulation property.

The first layer 25A is predominantly composed of SiN, and can be made of, for example, SiN containing N in an amount of greater than or equal to 57% by atom. The first layer 25A is configured to have a thickness of 0.5 μm to 12 μm, for example. As employed herein, the language "predominantly composed of SiN" refers to the fact that the percentage of Si content and the percentage of N content in the first layer 25A total up to 80% by atom or above. SiN designates a nitride of silicon, and Si3N4 can be taken up as an exemplary compound. Note that SiN is a compound having non-stoichiometric composition, which is not limited to Si3N4.

The first layer 25A, being predominantly composed of SiN, has no content of O. This helps decrease the possibility of oxidation of various electrodes and the heat-generating section 9 placed in contact with the first layer 25A.

Moreover, the first layer 25A can also be predominantly composed of silicon oxide (hereafter also referred to as "SiO"). SiO designates an oxide of silicon, and SiO2 can be taken up as an exemplary compound. Note that SiO is a compound having non-stoichiometric composition, which is not limited to SiO2. Note also that the first layer 25A may be configured to contain, in addition to SiN or SiO, an additive element such as Al in an amount of 1 to 5% by atom.

The second layer 25B is disposed on the first layer 25A, and, the heat-generating sections 9 is brought into contact with a recording medium, with the second layer 25B of the protective layer 25 lying between them. Therefore, the second layer 25B is required to make intimate contact with the first layer 25A. Moreover, in consideration of contact with a recording medium, the second layer 25B is required to have resistance to wear, hardness, and slipperiness.

The resistance to wear refers to the withstandability of the protective layer 25 against wear caused by the contact with a recording medium. If the mutual adherability of the layers constituting the protective layer 25 is low, the layers constituting the protective layer 25 may be separated from each other, which leads to the possibility of a decrease in the wear resistance of the protective layer 25. The hardness refers to the mechanical hardness of the protective layer 25, and, Vickers hardness can be taken up as an exemplary index. The slipperiness refers to ease of conveyance of a recording medium and an ink ribbon, and, poor slipperiness may cause a recording medium and an ink ribbon to become wrinkled.

The second layer 25B is a layer containing tantalum oxide (hereafter also referred to as "TaO") and silicon oxynitride (hereafter also referred to as "SiON"). The second layer 25B preferably contains Ta2O5 in an amount of 17 to 75% by volume, and SiON in an amount of 83 to 25% by volume, and more preferably contain Ta2O5 in an amount of 25 to 75% by volume, and SiON in an amount of 75 to 25% by volume.

TaO designates an oxide of tantalum, and Ta2O5 can be taken up as an exemplary compound. Note that TaO is a compound having non-stoichiometric composition, which is not limited to Ta2O5. In the following description, Ta2O5 will be adopted to explain TaO. SiON designates an oxynitride of silicon having non-stoichiometric composition. Note also that the second layer 25B may be configured to contain, in addition to TaO and SiON, another metal element as an additive element. Examples of the additive element include Ba, Ca, Cr, Mg, Mn, Mo, Nb, Sr, Ti, W, Y, Zn, and Zr.

Since the second layer 25B is provided in the form of a layer of a mixture of Ta2O5 and SiON, it is possible to increase the adherability between the first layer 25A and the second layer 25B, and thereby decrease the possibility of separation between the first layer 25A and the second layer 25B.

Moreover, with SiON content of 83 to 25% by volume, the wear resistance and the hardness of the protective layer 25 can be improved, and also, with Ta2O5 content of 17 to 75% by volume, slipperiness improvement can be achieved.

It is noted that Ta2O5 content can be increased in conformity with a recording medium for use. For example, when a non-slippery recording medium is used, the increase of Ta2O5 content makes it possible to increase the amount of Ta contained in the second layer 25B, and thereby improve the slipperiness of the second layer 25B. As the non-slippery recording medium, for example, a sublimation-type ink ribbon can be cited, which is a recording medium whose surface to be contacted by the protective layer 25 exhibits a high coefficient of friction.

Moreover, in the present embodiment, by virtue of the following characteristics of Ta2O5 constituting the second layer 25B, during printing process performed by the thermal head X1, it is possible to suppress occurrence of a phenomenon in which a recording medium such as paper is conveyed while being caught in the second layer 25B (so-called sticking phenomenon) while achieving wear-resistance improvement.

More specifically, one of possible factors responsible for the occurrence of the sticking phenomenon is that, when foreign matter such as paper powder is burnt and stuck onto the second layer 25B, then a great resistive force is developed in between the stuck foreign matter and the recording medium. In this regard, in the thermal head X1 of the present embodiment, since the second layer 25B is formed of a layer of a Ta2O5-containing material, it follows that, as the surface of the second layer 25B wears in moderation, the foreign matter stuck to the surface of the second layer 25B will be separated from the second layer 25B. This makes it possible to suppress the occurrence of the sticking phenomenon ascribable to the stuck foreign matter. Moreover, since the second layer 25B contains SiON having wear resistance, it is possible to impart enhanced wear resistance to the protective layer 25 while improving the slipperiness of the second layer 25B.

In addition to that, in the thermal head X1 of the present embodiment, the second layer 25B is not made of pure Ta, but is made of Ta2O5 which is an oxide of Ta. In this case, in contrast to a case where the second layer 25B is made of pure Ta, it is possible to render the second layer 25B chemically stable, and thereby achieve wear-resistance improvement. Accordingly, in the present embodiment, it is possible to suppress the occurrence of the sticking phenomenon while achieving wear-resistance improvement during printing process performed by the thermal head X1.

Moreover, in the second layer 25B, it is preferable that the ratio of O to Ta falls in the range of 2.02 to 3.71 in terms of atomic ratio, and it is more preferable that the ratio of O to Ta falls in the range of 2.02 to 3.0 in terms of atomic ratio. In order to adjust the ratio of O to Ta to fall in the range of 2.02 to 3.71 in terms of atomic ratio, for example, it is advisable to design the second layer 25B so that it contains Ta2O5 in an amount of 17 to 75% by volume, and SiON in an amount of 83 to 25% by volume.

The second layer 25B, being so configured that the ratio of O to Ta falls in the range of 2.02 to 3.71 in terms of atomic ratio, is capable of achieving further improvement in wear resistance while keeping excellent slipperiness. That is, it is possible to attain a thermal head X1 characterized by having a longer service life, and exhibiting enhanced wear resistance while decreasing the possibility of occurrence of wrinkles in an ink ribbon.

In the second layer 25B, since the ratio of O to Ta falls in the range of 2.02 to 3.71 in terms of atomic ratio, it follows that O content is higher than Ta content in terms of atomic ratio, with a consequent decrease in membrane stress existing in the second layer 25B. This makes it possible to improve the adherability of the second layer 25B, and thereby decrease the possibility of separation between the first layer 25A and the second layer 25B. Accordingly, the wear resistance of the protective layer 25 can be improved.

Moreover, in the second layer 25B, it is preferable that the ratio of Si to Ta falls in the range of 0.55 to 8.18 in terms of atomic ratio, and it is more preferable that the ratio of Si to Ta falls in the range of 1.6 to 5.0 in terms of atomic ratio. This makes it possible to increase bonds of SiO and SiN contained in the second layer 25B, and thereby achieve wear-resistance improvement.

Moreover, it is preferable that the ratio of N to Ta falls in the range of 0.57 to 8.61 in terms of atomic ratio, and it is more preferable that the ratio of N to Ta falls in the range of 0.57 to 5.17 in terms of atomic ratio. This makes it possible to increase SiN bonds. Since SiN bonds are made under a high binding force, it is possible to achieve further improvement in wear resistance. In addition, the increase of SiN bonds leads to enhancement in hardness.

Furthermore, the second layer 25B, being so configured that the ratio of N to Ta falls in the range of 0.57 to 8.61 in terms of atomic ratio, is capable of achieving wear-resistance improvement in the presence of SiN bonds while maintaining the slipperiness exhibited by Ta.

The second layer 25B preferably contains Si in an amount of 13 to 38% by atom, O in an amount of 17 to 49% by atom, and N in an amount of 14 to 40% by atom, and more preferably contain Si in an amount of 25 to 35% by atom, O in an amount of 21 to 34% by atom, and N in an amount of 26 to 37% by atom. So long as the content of the constituent element of the second layer 25B falls within the prescribed range as above described, the adherability between the second layer 25B and the first layer 25A can be increased. Moreover, the hardness of the second layer 25B can be increased. Furthermore, the wear resistance of the second layer 25B can be improved. In addition, the slipperiness of the second layer 25B can be improved.

It is noted that the content of each of various elements contained in the second layer 25B can be confirmed by means of, for example, X-ray photoelectron spectroscopy (XPS) analysis.

The protective layer 25 comprising the first layer 25A and the second layer 25B thus far described can be formed in the following manner, for example.

The first step is to form the first layer 25A on the heat-generating section 9, the common electrode 17, and the discrete electrode 19. Specifically, sputtering is performed on a sintered product composed predominantly of SiN used as a sputtering target to form a SiN-containing first layer 25A. In the case of forming a SiO-containing first layer 25A, it is advisable to use a sintered product composed predominantly of SiO as a sputtering target.

The next step is to form the second layer 25B on the first layer 25A. Specifically, for example, with use of two sputtering targets, namely a SiON sintered product of a mixture in which the ratio of Si3N4 to SiO2 is 50 to 50, and a Ta2O5 sintered product, sputtering is carried out to form a SiON and Tao-containing second layer 25B. Note that SiON content and TaO content in the second layer 25B can be controlled by, for example, making changes to the value of RF voltage to be applied to the sputtering targets. For example, the content of SiON in second layer 25B can be increased by increasing the value of RF voltage to be applied to the SiON sputtering target. Note also that a sintered product of a mixture obtained by mixing SiON and Ta2O5 at a predetermined mixing ratio may be used as a sputtering target, and that sputtering may be performed on a sputtering target containing another element as an additive.

In the manner as above described, the protective layer 25 comprising the first layer 25A and the second layer 25B can be formed. In performing sputtering to form each layer, heretofore known sputtering method, for example, high-frequency sputtering technique, non-bias sputtering technique, or bias sputtering technique can be adopted for use as appropriate.

As shown in FIG. 1 and FIG. 2, a cover layer 27 for partly covering the common electrode 17, the discrete electrode 19, and the connection electrode 21 is provided on the heat-accumulating layer 13 disposed on the upper surface of the substrate 7. In FIG. 1, for convenience in explanation, a region where the cover layer 27 is disposed is indicated by alternate long and short dashed lines, and its diagrammatic representation is omitted. In the illustrated example, the cover layer 27 is so disposed as to partly cover an area of the upper surface of the heat-accumulating layer 13 which is located on the right side of the protective layer 25. The cover layer 27 is intended to protect the covered areas of the common electrode 17, the discrete electrode 19, and the connection electrode 21 from oxidation caused by contact with air, or from corrosion caused by the adherence of atmospheric water content, for example. Note that, as shown in FIG. 2, the cover layer 27 is so formed as to overlap with the end of the protective layer 25 to protect the common electrode 17 and the discrete electrode 19 more reliably. The cover layer 27 can be made of a resin material such for example as epoxy resin or polyimide resin. Moreover, the cover layer 27 can be formed by thick-film forming method such for example as screen printing technique.

As shown in FIG. 1 and FIG. 2, the ends of the sub wiring part 17*b* of the common electrode 17 and the connection electrode 21 for connection to the FPC 5 as will hereafter be described are left exposed out of the cover layer 27 so as to be connected with the FPC 5.

Moreover, the cover layer 27 is formed with an opening (not shown in the drawings) which leaves the ends of the discrete electrode 19 and the connection electrode 21 for connection to the driving IC 11 exposed, so that these wiring lines can be connected to the driving IC 11 through the opening. Furthermore, the driving IC 11 is covered and sealed with a covering member 29 made of resin such for example as epoxy resin or silicone resin, while being connected to the discrete electrode 19 and the connection electrode 21, to protect the driving IC 11 in itself and the part of connection between the driving IC 11 and each wiring line.

As shown in FIG. 1 and FIG. 2, the FPC 5 extends along the longitudinal direction of the substrate 7, and is connected to the sub wiring part 17*b* of the common electrode 17 and each of the connection electrodes 21 as above described. The FPC 5 is a heretofore known component constructed by installing a plurality of printed wiring lines 5*b* in the interior of an insulating resin layer 5*a*, in which each of the printed wiring lines is electrically connected to external power-supply equipment, control equipment, and so forth via a connector 31. As shown in FIG. 1 and FIG. 2, in the FPC 5, at its head base body 3-sided end part, the printed wiring line 5*b* is connected to the end of the sub wiring part 17*b* of the common electrode 17 and the end of each of the connection electrodes 21 by a joining member 32 (refer to FIG. 2) made of a solder material which is an electrically conductive joining material, an anisotropic conductive film (ACF) obtained by mixing conductive particles into electrically insulating resin, or the like.

A reinforcement plate 33 made of resin such for example as phenol resin, polyimide resin, or glass epoxy resin is disposed between the FPC 5 and the heat dissipator 1. The reinforcement plate 33 is bonded to the lower surface of the FPC 5 by means of double-faced tape, an adhesive, or otherwise (not shown in the drawings) to serve the function of reinforcing the FPC 5. Moreover, the FPC 5 is fixedly placed on the heat dissipator 1 by bonding the reinforcement plate 33 to the upper surface of the heat dissipator 1 by means of double-faced tape, an adhesive, or otherwise (not shown).

Figure 4:
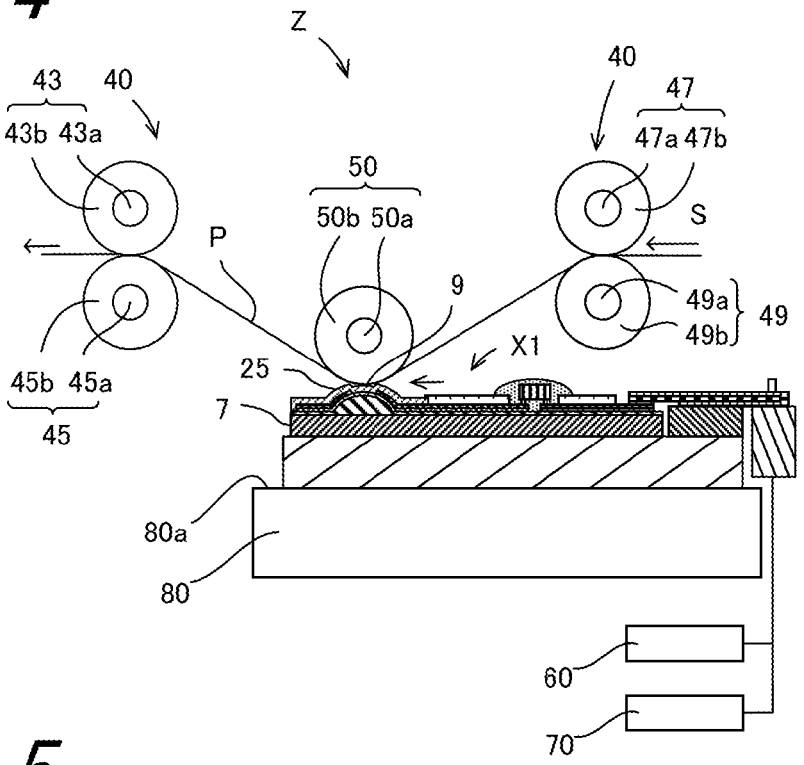
FIG. 4 is a view schematically showing the structure of one embodiment of a thermal printer pursuant to the invention.

Next, one embodiment of a thermal printer pursuant to the invention will be described with reference to FIG. 4. FIG. 4 is a schematic diagram showing the structure of a thermal printer Z of the present embodiment.

As shown in FIG. 4, the thermal printer Z of the present embodiment comprises: the thermal head X1 thus far described; a conveyance mechanism 40; a platen roller 50; a power-supply device 60; and a control device 70. The thermal head X1 is attached to a mounting surface 80*a* of a mounting member 80 disposed in a cabinet for the thermal printer Z (not shown in the drawing). The thermal head X1 is mounted on the mounting member 80 in a manner such that the arrangement direction of the heat-generating sections 9 conforms to a main scanning direction perpendicular to a conveying direction S in which a recording medium P is conveyed that will hereafter be described.

The conveyance mechanism 40, which is intended to convey a recording medium P, such as thermal paper, ink-transferable image-receiving paper, and the like, in a direction indicated by arrow S in FIG. 4 onto the protective layer 25 situated on the plural heat-generating sections 9 of the thermal head X1, comprises conveying rollers 43, 45, 47, and 49. For example, the conveying roller 43, 45, 47, 49 can be constructed of a cylindrical shaft body 43*a*, 45*a*, 47*a*, 49*a* made of metal such as stainless steel covered with an elastic member 43*b*, 45*b*, 47*b*, 49*b* made of butadiene rubber or the like. Although not shown in the drawing, where ink-transferable image-receiving paper or the like is used as the recording medium P, the recording medium P is conveyed together with an ink film being put between the recording medium P and the heat-generating sections 9 of the thermal head X1.

The platen roller 50, which is intended to press the recording medium P onto the heat-generating section 9 of the thermal head X1, is disposed so as to extend along a direction perpendicular to the recording-medium P conveying direction S, and is supported, at its ends, so that it is able to rotate while pressing the recording medium P onto the heat-generating section 9. For example, the platen roller 50 can be constructed of a cylindrical shaft body 50*a* made of metal such as stainless steel covered with an elastic member 50*b* made of butadiene rubber or the like.

The power-supply device 60 is intended to supply electric current for causing the heat-generating sections 9 of the thermal head X1 to generate heat as above described, and also electric current for operating the driving IC 11. The control device 70 is intended to supply control signals for controlling the operation of the driving IC 11 to the driving IC 11 in order to cause the heat-generating sections 9 of the thermal head X1 to generate heat in a selective manner as above described.

In the thermal printer Z of the present embodiment, as shown in FIG. 4, the recording medium P is conveyed, while being pressed onto the heat-generating sections 9 of the thermal head X1 by the platen roller 50, onto the heat-generating sections 9 by the conveyance mechanism 40, and simultaneously the heat-generating sections 9 are caused to generate heat in a selective manner by the power-supply device 60 and the control device 70, whereby predetermined printing can be performed on the recording medium P. In the case of using image-receiving paper or the like as the recording medium P, printing can be performed on the recording medium P by thermally transferring the ink of an ink film (not shown) being conveyed together with the recording medium P to the recording medium P.

Second Embodiment

Figure 5:
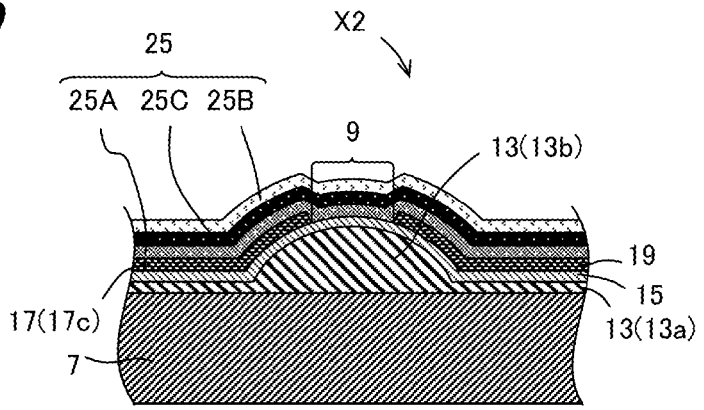
FIG. 5 is an enlarged view of the region Q shown in FIG. 2, illustrating another embodiment of the thermal head of the invention.

A thermal head X2 in accordance with the second embodiment will be described with reference to FIG. 5. In the thermal head X2, the protective layer 25 further comprises a SiON-containing close adherent layer 25C which is interposed between the first layer 25A and the second layer 25B. Otherwise, the thermal head X2 is similar to the thermal head X1 in accordance with the first embodiment, wherefore other description thereof will be omitted.

The close adherent layer 25C is made of SiON, and has the effect of increasing the adherability between the first layer 25A and the second layer 25B. The close adherent layer 25C is predominantly composed of SiON, and more specifically contains Si, O, and N in a total amount of greater than or equal to 85% by atom. Note that the close adherent layer 25C may be configured to contain an additive element such as Al in an amount of 0.1 to 5% by atom.

The close adherent layer 25C can be formed by performing sputtering on a SiON sintered product used as a sputtering target. The close adherent layer 25C can be configured to have a thickness of 0.1 to 0.5 μm.

In the thermal head X2, the protective layer 25 includes the SiON-containing close adherent layer 25C interposed between the first layer 25A and the second layer 25B. In this case, in contrast to a case where no close adherent layer 25C is interposed between the first layer 25A and the second layer 25B, it is possible to improve the adherability of the second layer 25B situated on the first layer 25A, and thereby suppress the occurrence of separation of the second layer 25B.

Thus, in the case of interposing the close adherent layer 25C between the first layer 25A and the second layer 25B, in contrast to the case where the close adherent layer 25C is not interposed, it is possible to raise the energy of bonding between the first layer 25A and the second layer 25B, and thereby increase the adherability of the second layer 25B onto the first layer 25A. As a result, the occurrence of separation of the second layer 25B can be suppressed.

For example, the above-described protective layer 25 comprising the first layer 25A, the second layer 25B, and the close adherent layer 25C can be formed in the following manner.

At first, the first layer 25A is formed on the heat-generating section 9, the common electrode 17, and the discrete electrode 19. Subsequently, the close adherent layer 25C is formed by performing sputtering on a SiON-containing sintered product used as a sputtering target. Then, the second layer 25B is formed on the close adherent layer 25C, whereupon the thermal head X2 can be produced. Where a SiON sputtering target and a Ta2O5 sputtering target are used for the formation of the second layer 25B in particular, it is advisable to apply RF voltage only to the SiON sputtering target when the close adherent layer 25C is formed, and apply RF voltage to both of the SiON sputtering target and the Ta2O5 sputtering target when the second layer 25B is formed.

Moreover, the close adherent layer 25C may be predominantly composed of tantalum nitride (hereafter also referred to as "TaN"). TaN designates a nitride of tantalum, and Ta3N5 can be taken up as an exemplary compound. Note that TaN is a compound having non-stoichiometric composition, which is not limited to Ta3N5.

Also in the case where the close adherent layer 25C is made of TaN, it is possible to improve the adherability of the second layer 25B situated on the first layer 25A, and thereby suppress the occurrence of separation of the second layer 25B. Especially when the first layer 25A is made of SiN and the second layer 25B is made of TaO and SiON, the close adherent layer 25C will contain the constituent element of the first layer 25A and the constituent element of the second layer 25B, with consequent further improvement in adherability.

It is noted that the close adherent layer 25C may be configured to contain SiON and TaN. Also in this case, the same effects as above described can be achieved.

Third Embodiment

Figure 6:
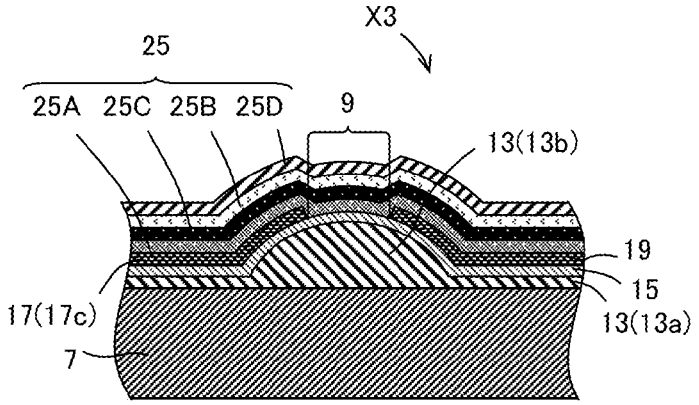
FIG. 6 is an enlarged view of the region Q shown in FIG. 2, illustrating still another embodiment of the thermal head of the invention.

A thermal head X3 in accordance with the third embodiment will be described with reference to FIG. 6. The thermal head X3 differs from the thermal head X2 of the second embodiment in that the protective layer 25 further comprises a third layer 25D which is provided on the second layer 25B, but is otherwise similar to the thermal head X2.

The third layer 25D is so disposed as to cover the upper surface of the second layer 25B, and has the capability of dissipating static electricity generated in the third layer 25D to the outside. Therefore, the third layer 25D is maintained at a ground potential. By virtue of the static-removal capability of the third layer 25D, it is possible to decrease the possibility of occurrence of electrostatic breakdown caused by static electricity in the protective layer 25 of the thermal head X3.

The third layer 25D can be formed with use of Ta2O5 or tantalum silicon oxide (hereafter also referred to as "TaSiO"). The third layer 25D may be configured to have a thickness of 0.01 to 3 μm, and preferably exhibits a specific resistance of 10-2 to 10-4Ω×cm. Since the specific resistance falls in the range of 10-2 to 10-4Ω×cm, static electricity generated in the third layer 25D can be dissipated to the outside efficiently, with consequent successful removal of static electricity.

In the thermal head X3, since the protective layer 25 is so configured that the second layer 25B containing SiON and Ta2O5 and the Ta2O5- or TaSiO-made third layer 25D are disposed on the SiON-containing close adherent layer 25C, it follows that a thermal stress occurring between the close adherent layer 25C and the third layer 25D is reduced, wherefore the wear resistance of the protective layer 25 can be improved. That is, since the second layer 25B contains SiON constituting the close adherent layer 25C and Ta2O5 constituting the third layer 25D, it is possible to improve the adherability of the protective layer 25.

As the method of forming the third layer 25D, the first step is to form the SiN-containing first layer 25A on the heat-generating section 9, the common electrode 17, and the discrete electrode 19. The next step is to form the close adherent layer 25C on the first layer 25A. Specifically, sputtering is performed on a sintered product of a SiN—SiO2 mixture in which the ratio of SiN to SiO2 is 50 to 50 used as a sputtering target to form a SiON-containing close adherent layer 25C.

After that, the second layer 25B is formed on the close adherent layer 25C. Specifically, while continuing the SiON sputtering for forming the close adherent layer 25C as above described, sputtering is performed on a Ta2O5 sintered product used as a sputtering target. In this way, the second layer 25B in the form of a SiON—Ta2O5 mixture layer can be formed.

Subsequently, the third layer 25D is formed on the second layer 25B. Specifically, after the above-described SiON sputtering which has been continued in the second layer 25B-forming process is stopped, a Ta2O5-containing third layer 25D is formed by continuing only the sputtering using the Ta2O5 sintered product as a sputtering target.

In the manner thus far described, the protective layer 25 comprising the first layer 25A, the close adherent layer 25C, the second layer 25B, and the third layer 25D can be formed.

It is noted that, following the formation of the third layer 25D on the second layer 25B, the third layer 25D situated on the heat-generating section 9 may be removed by performing lapping treatment. By the lapping treatment, the second layer 25B is left exposed on the heat-generating section 9, wherefore a recording medium is brought into contact with the second layer 25B. Also in this case, static electricity generated on the surface of the protective layer 25 is dissipated to the outside through the third layer 25D.

Fourth Embodiment

Figure 7:
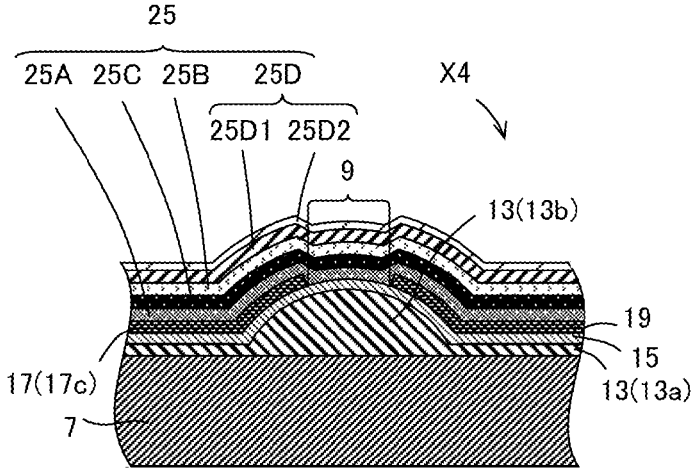
FIG. 7 is an enlarged view of the region Q shown in FIG. 2, illustrating still another embodiment of the thermal head of the invention.

A thermal head X4 in accordance with the fourth embodiment will be described with reference to FIG. 7. The thermal head X4 is a modified example of the thermal head X3, in which the third layer 25D is made of Ta2O5, and has, on its side located opposite to the second layer 25B, a Ta-rich region 25D2 which is higher in Ta content than the other side located toward the second layer 25B.

In the thermal head X4, the protective layer 25 is so configured that the third layer 25D is composed of: a lower layer 25D1 situated on the second layer 25B, or equivalently the side located toward the second layer 25B; and the Ta-rich region 25D2 having a higher Ta content located on the side opposite to the second layer 25B.

That is, the Ta-rich region 25D2 is higher in Ta content than the lower layer 25D1, and is thus lower in specific resistance than the lower layer 25D1. Accordingly, as compared with the lower layer 25D1, the Ta-rich region 25D2 allows static electricity to flow therethrough more easily, with consequent enhancement in static-removal capability.

The lower layer 25D1 preferably has a thickness of 1 to 3 μm, and the Ta-rich region 25D2 preferably has a thickness of 0.1 to 0.5 μm. The Ta content of the Ta-rich region 25D2 is preferably 1.5 to 3 times greater than the Ta content of the lower layer 25D1. Thereby, the specific resistance of the Ta-rich region 25D2 can be reduced to a level of about 10 times lower than the specific resistance of the lower layer 25D1.

Moreover, the third layer 25D may be so configured that its Ta content becomes higher gradually toward the surface thereof. Thus, so long as the Ta content becomes higher gradually toward the surface of the third layer 25D, the specific resistance can become lower gradually toward the surface of the third layer 25D correspondingly, with consequent enhancement in the static-removal capability of the third layer 25D.

Hereinafter, a method for producing the thermal head X4 will be described.

In accordance with a method similar to the method of producing the thermal head X1, following the formation of the first layer 25A and the second layer 25B, the third layer 25D is formed by performing sputtering on a Ta2O5 sintered product used as a sputtering target.

Then, the lower layer 25D1 is formed by the application of RF voltage to the sputtering target. After the lower layer 25D1 is adjusted to have a desired thickness, the RF voltage applied to the sputtering target is raised to form the Ta-rich region 25D2. In the case of performing continuous film formation starting with the creation of the second layer 25B, it is advisable that, following the formation of the second layer 25B, RF voltage application to the SiON sputtering target is stopped, and RF voltage application is continued only for the Ta2O5 sputtering target.

Moreover, as the method of forming the third layer 25D in which the Ta content becomes higher gradually toward the surface thereof, by controlling the applied RF voltage so that it rises over time, it is possible for the Ta content to become higher gradually toward the surface of the third layer 25D, and thereby form the Ta-rich region 25D2.

Furthermore, it is possible to achieve a relative increase in Ta content in the Ta-rich region 25D2 by performing sputtering in a reductive atmosphere under the supply of nitrogen gas during sputtering.

It is noted that the third layer 25D may be made of TaSiO, and the TaSiO-made third layer 25D may have, on its side located opposite to the second layer 25B, a Ta-rich region 25D2 which is higher in Ta content than a lower layer 25D1. Also in this case, the same effects as above described can be achieved.

While one embodiment of the invention has been described, it should be understood that the application of the invention is not limited to the embodiment described heretofore, and that many modifications and variations of the invention are possible within the scope of the invention. For example, although the above description deals with the thermal printer Z employing the thermal head X1 implemented as the first embodiment, the thermal printer is not limited to such constitution, and thus the thermal heads X2 to X5 may be adopted for use in the thermal printer Z. Moreover, the thermal heads X1 to X5 implemented as a plurality of embodiments may be used in combination.

Moreover, although, in the thermal head X1 shown in FIG. 1 to FIG. 3, the protuberant part 13*b* is formed in the heat-accumulating layer 13, and the electrical resistance layer 15 is formed on the protuberant part 13*b*, the thermal head is not limited to such constitution. For example, the protuberant part 13*b* does not have to be formed in the heat-accumulating layer 13, and, in this case, the heat-generating section 9 of the electrical resistance layer 15 may be placed on the base part 13*b* of the heat-accumulating layer 13. Alternatively, the heat-accumulating layer 13 does not have to be formed, and, in this case, the electrical resistance layer 15 may be placed on the substrate 7.

Figure 8:
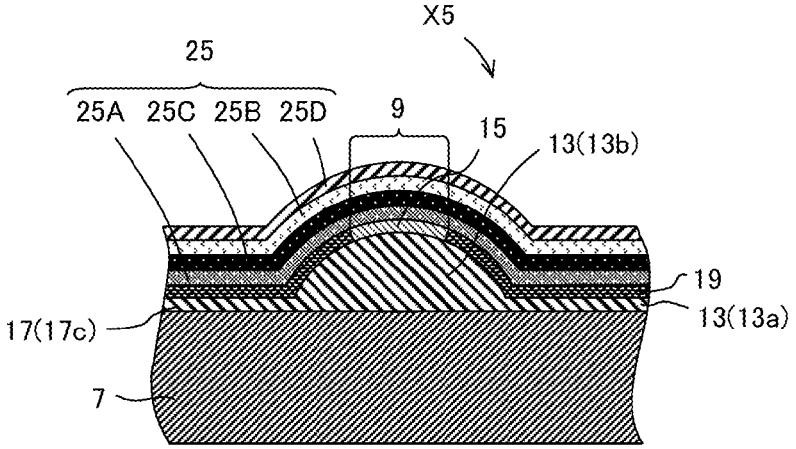
FIG. 8 is an enlarged view of the region Q shown in FIG. 2, illustrating still another embodiment of the thermal head of the invention.

Moreover, although, in the thermal head X1 shown in FIG. 1 to FIG. 3, the common electrode 17 and the discrete electrode 19 are formed on the electrical resistance layer 15, the thermal head is not limited to such constitution insofar as both the common electrode 17 and the discrete electrode 19 are connected to the heat-generating section 9 (electric resistor). For example, as practiced in the thermal head X5 shown in FIG. 8, the common electrode 17 and the discrete electrode 19 may be formed on the heat-accumulating layer 13, and, in this case, the electrical resistance layer 15 may be formed only in a region between the common electrode 17 and the discrete electrode 19 to constitute the heat-generating section 9.

Moreover, although the protective layer 25 is illustrated as having the form of at least two layers, namely the first layer 25A and the second layer 25B, the protective layer is not limited to such constitution. For example, the protective layer 25 may be given a layered structure obtained by stacking a plurality of first and second layers 25A and 25B alternately one after another. In this case, it is desirable to reduce the thickness of each of the first layer 25A and the second layer 25B constituting the protective layer 25 so that the protective layer 25 as a whole has a thickness of 5 to 15 μm. This makes it possible to transmit heat generated in the heat-generating section 9 to a recording medium properly.

Examples

The following experiments were conducted for the purpose of investigating the slipperiness, the hardness, the resistance to wear, and the adherability of the thermal head in accordance with the embodiments of the invention.

A plurality of substrates provided with various electrode wiring lines, including the common electrode, the discrete electrode, and the connection electrode, were prepared for use as test samples. Then, a 5 μm-thick SiN first layer was formed on each of the substrates of test sample Nos. 1 through 20, and 22 through 24 by means of sputtering. On the other hand, a 5 μm-thick SiO first layer was formed on the substrate of a test sample No. 21 by means of sputtering.

Next, in order to form the protective layer, sputtering targets for the test sample Nos. 2 through 9 as listed in Table 1 were produced. Each sputtering target was produced by mixing SiON powder and Ta2O5 powder at a volumetric ratio as listed in Table 1, and subsequently firing the mixture. Moreover, aside from the sputtering targets, sintered products were produced for Vickers hardness tests specified by JIS R1610.

By way of comparative examples, a sputtering target for the test sample No. 1 was produced by firing SiON powder. Similarly, a sputtering target for the test sample No. 10 was produced by firing Ta2O5 powder.

By way of comparative examples, sputtering targets for the test sample Nos. 11 through 13 were each produced by mixing SiN powder and Ta2O5 powder at a volumetric ratio as listed in Table 2, and subsequently firing the mixture.

Sputtering targets, as well as sintered products for Vickers hardness tests specified by JIS R1610, for the test sample Nos. 14 through 20 were each produced by mixing SiON powder and Ta2O5 powder at an atomic ratio as listed in Table 3, and subsequently firing the mixture.

SiON having Si, O, and N in a 4:1:5 ratio by atom was used. SiN having Si and N in a 3:4 ratio by atom was used. Ta2O5 having Ta and O in a 2:5 ratio by atom was used.

The sputtering targets for the test sample Nos. 1 through 24 were placed in a batch and a 10 μm-thick second layer was formed on each of the substrates of the test samples formed with the 5 μm-thick first layer. Note that, in the test sample Nos. 21 through 24, a 10 μm-thick second layer which is the same as the second layer of the test sample No. 5 was formed. Moreover, in each of the test sample Nos. 22 through 24, following the formation of the first layer, the second layer was formed after forming a 0.5 μm-thick close adherent layer having a composition as listed in Table 4. In the test sample No. 24, the close adherent layer was made as a layer of a SiON—TaN mixture in which the volumetric ratio of SiON to TaN is 50 to 50.

Next, thermal heads were constructed by mounting a driving IC on each substrate formed with the second layer, and the following running tests were conducted.

Thermal printers equipped with the thermal heads of test sample Nos. 1 through 20 have been driven to run for 10000 copies with use of a sublimation-type ink ribbon as a recording medium (media size A6) under the following conditions: printing period is 0.7 ms/line; applied voltage is 0.18 to 0.30 W/dot; and pressing force is 8 to 11 kg×F/head. Then, the thermal head was taken out of the thermal printer following the completion of the running test, and the amount of wear was measured by means of stylus-type surface shape measuring equipment or non-contact surface shape measuring equipment, or a generally known surface roughness meter.

Test samples in which the amount of wear is less than or equal to 3 μm were rated as having wear resistance, and marked with "O" as presented in Tables 1 to 3, whereas those in which the amount of wear is greater than 3 μm were rated as lacking wear resistance, and marked with "X" as presented in Tables 1 to 3. Moreover, the protective layer of each thermal head having undergone the running test was visually inspected under a microscope to check for the presence or absence of separation between the first layer and the second layer. Test samples free from separation between the first and second layers were rated as having adherability, and marked with "O" as presented in Tables 1 to 4, whereas those suffering from the separation were rated as lacking adherability, and marked with "X" as presented in Tables 1 to 4.

Moreover, after similar running tests were conducted for 5000 copies, test samples suffering from the occurrence of wrinkles in the ink ribbon were rated as lacking slipperiness, and marked with "X" as presented in Tables 1 to 3. After slipperiness examinations, further running tests were conducted for 10000 copies in total. Test samples in which there was no sign of wrinkles in the ink ribbon at the completion of 5000 copies but wrinkles were developed therein at the completion of 10000 copies were marked with "A" as presented in Tables 1 to 3. On the other hand, those in which there was no sign of wrinkles in the ink ribbon at the completion of 10000 copies were rated as having slipperiness, and marked with "O" as presented in Tables 1 to 3.

Moreover, Vickers hardness measurement was performed on the sintered product of each test sample in conformity to JIS R1610. The measurement result is listed in Tables 1 to 3.

TABLE 1

| | Second layer | | | Evaluation points | | | | |
|---|---|---|---|---|---|---|---|---|
| Sample No. | SiON:TaO | O/Ta | N/Ta | Slipperiness | Hardness Hv | Wear resistance | Amount of wear (10000 copies) μm | Adherability |
| *1 | 100:0 | — | — | X | 1300 | ○ | 0.2 | ○ |
| 2 | 90:10 | 5.12 | 15.50 | Δ | 1222 | ○ | 0.2 | ○ |
| 3 | 83:17 | 3.71 | 8.61 | ○ | 1172 | ○ | 0.2 | ○ |
| 4 | 80:20 | 3.33 | 6.89 | ○ | 1152 | ○ | 0.2 | ○ |
| 5 | 75:25 | 2.98 | 5.17 | ○ | 1119 | ○ | 0.3 | ○ |
| 6 | 50:50 | 2.26 | 1.72 | ○ | 980 | ○ | 0.7 | ○ |
| 7 | 25:75 | 2.02 | 0.57 | ○ | 884 | ○ | 1.2 | ○ |
| 8 | 20:80 | 1.99 | 0.43 | ○ | 870 | ○ | 2.8 | ○ |
| 9 | 17:83 | 1.97 | 0.34 | ○ | 862 | X | 4.3 | ○ |
| *10 | 0:100 | 1.90 | — | ○ | 830 | X | 9 | ○ |

Asterisk (*) denotes departure from the scope of the invention.

TABLE 2

| | Second layer | | Evaluation points | | | | |
|---|---|---|---|---|---|---|---|
| Sample No. | SiN:TaO | O/Ta | Slipperiness | Hardness Hv | Wear resistance | Amount of wear (10000 copies) μm | Adherability |
| *11 | 80:20 | 1.9 | X | 1292 | ○ | 0.2 | X |
| *12 | 75:25 | 1.9 | X | 1246 | ○ | 0.3 | X |
| *13 | 50:50 | 1.9 | Δ | 1050 | X | 0.3 | X |

Asterisk (*) denotes departure from the scope of the invention.

TABLE 3

| | Second layer | | | | Evaluation points | | | | |
|---|---|---|---|---|---|---|---|---|---|
| Sample No. | Si (atom %) | O (atom %) | N (atom %) | Ta (atom %) | Slipperiness | Hardness Hv | Wear resistance | Amount of wear (10000 copies) μm | Adherability |
| 14 | 38 | 17 | 40 | 6 | Δ | 1222 | ○ | 0.2 | ○ |
| 15 | 37 | 19 | 39 | 6 | Δ | 1148 | ○ | 0.2 | ○ |
| 16 | 35 | 21 | 37 | 7 | ○ | 1120 | ○ | 0.3 | ○ |
| 17 | 25 | 34 | 26 | 15 | ○ | 985 | ○ | 0.3 | ○ |
| 18 | 13 | 49 | 14 | 24 | ○ | 880 | ○ | 0.3 | ○ |
| 19 | 11 | 52 | 11 | 26 | ○ | 852 | ○ | 2.6 | ○ |
| 20 | 5 | 59 | 6 | 30 | ○ | 834 | X | 7.2 | ○ |

TABLE 4

| Sample No. | First layer | Close adherent layer | Second layer | Adherability |
|---|---|---|---|---|
| 21 | SiO | — | TaO + SiON | ○ |
| 22 | SiN | SiON | TaO + SiON | ○ |
| 23 | SiN | TaN | TaO + SiON | ○ |
| 24 | SiN | SiON + TaN | TaO + SiON | ○ |

As shown in Table 1, the test sample Nos. 2 through 9 falling within the scope of the invention are excellent in slipperiness and wear resistance, and exhibits high hardness of greater than or equal to 862 Hv.

In particular, the test sample Nos. 3 through 7 in which the atomic ratio of O to Ta falls in the range of 2.02 to 3.71 are all marked with "O" in respect of slipperiness, and are also marked with "O" in respect of wear resistance; that is, the wear amounts thereof were found to be less than or equal to 1.2 μm.

Moreover, the test sample Nos. 3 through 7 in which the atomic ratio of N to Ta falls in the range of 0.57 to 8.62 are all excellent in hardness, wear resistance, and adherability, and also, in all of them, there was no sign of wrinkles in the ink ribbon even at the completion of 10000 copies in the running test, which has proven excellent slipperiness.

Furthermore, as for the test sample Nos. 5 through 7 in which the atomic ratio of O to Ta falls in the range of 2.02 to 2.98 and the atomic ratio of N to Ta falls in the range of 0.57 to 5.17, the thermal printer equipped with each of them has been operated at high speed in a printing period of 0.3 ms/line to conduct a running test for 10000 copies, and, the test result showed that, in all of them, the slipperiness is excellent and the amount of wear in the protective layer is so small as to fall in the range of 0.6 to 1.8 μm.

On the other hand, the test sample No. 1 made of SiON implemented as comparative example, while being found to have excellent wear resistance and high hardness, exhibited poor slipperiness. Also, the test sample No. 10 made of Ta2O5 implemented as comparative example, while being found to have excellent slipperiness, exhibited poor wear resistance and low hardness.

Moreover, as shown in Table 2, the test samples Nos. 11 and 12 containing SiN and Ta2O5 implemented as comparative examples were found to have poor slipperiness. Furthermore, the test sample Nos. 11 through 13 implemented as comparative examples are all marked with "X" in respect of adherability due to the occurrence of separation between the first layer and the second layer.

Furthermore, as shown in Table 3, in the test sample Nos. 14 through 18 in which Si content is 13 to 38% by atom; O content is 17 to 49% by atom; N content is 14 to 40% by atom; and Ta content is 5 to 24% by atom, the hardness was greater than or equal to 880 Hv, and the amount of wear was less than or equal to 0.3 μm even at the completion of 10000 copies in the running test. Moreover, these test samples were found to be excellent in adhesion between the first layer and the second layer, and to have high slipperiness.

In particular, in the test sample Nos. 16 through 18 in which Si content is 13 to 35% by atom; O content is 21 to 49% by atom; N content is 14 to 37% by atom; and Ta content is 7 to 24% by atom, the slipperiness was excellent and the amount of wear was small.

As shown in Table 4, the test sample No. 21 having the SiO-made first layer showed no sign of separation between the first layer and the second layer, and is therefore marked with "O" in respect of adherability. Also, each of the test sample No. 22 having the SiON-made close adherent layer, the test sample No. 23 having the TaN-made close adherent layer, and the test sample No. 24 having the close adherent layer made of SiON and TaN showed no sign of separation between the first layer and the second layer, and is therefore marked with "O" in respect of adherability.

REFERENCE SIGNS LIST

X1-X5: Thermal head
Z: Thermal printer
1: Heat dissipator
3: Head base body
5: Flexible printed circuit board
7: Substrate
9: Heat-generating section
11: Driving IC
17: Common electrode
17*a*: Main wiring part
17*b*: Sub wiring part
17*c*: Lead part
19: Discrete electrode
21: Connection electrode
25: Protective layer
25A: First layer
25B: Second layer
25C: Close adherent layer
25D: Third layer
25D1: Lower layer
25D2: Ta-rich region
27: Cover layer

The invention claimed is:

1. A thermal head, comprising:
a substrate;
an electrode disposed on the substrate;
a heat-generating section connected to the electrode; and
a protective layer disposed on the electrode and on the heat-generating section,
the protective layer including
a first layer containing silicon nitride or silicon oxide;
a second layer disposed on the first layer, containing tantalum oxide and silicon oxynitride; and
a close adherent layer interposed between the first layer and the second layer, containing silicon oxynitride.

2. The thermal head according to claim 1,
wherein, in the second layer, a ratio of O to Ta falls in a range of 2.02 to 3.71 in terms of atomic ratio.

3. The thermal head according to claim 1,
wherein the second layer contains Si in an amount of 13 to 38% by atom, O in an amount of 17 to 49% by atom, N in an amount of 14 to 40% by atom, and Ta in an amount of 5 to 24% by atom.

4. The thermal head according to claim 1,
wherein, in the second layer, a ratio of N to Ta falls in a range of 0.57 to 8.61 in terms of atomic ratio.

5. The thermal head according to claim 1,
wherein the protective layer further includes a third layer disposed on the second layer, containing tantalum silicon oxide.

6. The thermal head according to claim 5,
wherein the third layer has, on its side located opposite to the second layer, a Ta-rich region which is higher in Ta content than its other side located toward the second layer.

7. The thermal head according to claim 1,
wherein the protective layer further includes a third layer disposed on the second layer, containing tantalum oxide,
and wherein the third layer has, on its side located opposite to the second layer, a Ta-rich region which is higher in Ta content than its other side located toward the second layer.

8. A thermal printer, comprising:
the thermal head according to claim 1;
a conveyance mechanism which conveys a recording medium onto the heat-generating section; and
a platen roller which presses the recording medium onto the heat-generating section.

9. A thermal head, comprising:
a substrate;
an electrode disposed on the substrate;
a heat-generating section connected to the electrode; and
a protective layer disposed on the electrode and on the heat-generating section,
the protective layer including
a first layer containing silicon nitride or silicon oxide;
a second layer disposed on the first layer, containing tantalum oxide and silicon oxynitride; and
a close adherent layer interposed between the first layer and the second layer, containing tantalum nitride.

10. A thermal printer, comprising:
the thermal head according to claim 9;
a conveyance mechanism which conveys a recording medium onto the heat-generating section; and
a platen roller which presses the recording medium onto the heat-generating section.

11. A thermal head, comprising:
a substrate;
an electrode disposed on the substrate;
a heat-generating section connected to the electrode; and
a protective layer disposed on the electrode and on the heat-generating section,
the protective layer including
a first layer containing silicon nitride or silicon oxide;
a second layer disposed on the first layer, containing tantalum oxide and silicon oxynitride; and
a third layer disposed on the second layer, containing tantalum silicon oxide.

12. The thermal head according to claim 11,
wherein the third layer has, on its side located opposite to the second layer, a Ta-rich region which is higher in Ta content than its other side located toward the second layer.

13. A thermal printer, comprising:
the thermal head according to claim 11;
a conveyance mechanism which conveys a recording medium onto the heat-generating section; and
a platen roller which presses the recording medium onto the heat-generating section.

* * * * *